United States Patent [19]

Abildgaard et al.

[11] 4,369,013

[45] Jan. 18, 1983

[54] BOOKBINDING STRIPS

[75] Inventors: William H. Abildgaard, Los Altos Hills; Charles T. Groswith, III, Los Altos, both of Calif.

[73] Assignee: Velo-Bind, Inc., Sunnyvale, Calif.

[21] Appl. No.: 142,269

[22] Filed: Apr. 21, 1980

Related U.S. Application Data

[63] Continuation-in-part of Ser. No. 710,185, Jul. 30, 1976, abandoned, which is a continuation of Ser. No. 872,134, Oct. 29, 1969, abandoned, which is a continuation-in-part of Ser. No. 799,045, Feb. 13, 1969, Pat. No. 3,596,929.

[51] Int. Cl.[3] ..... B42B 5/08

[52] U.S. Cl. ..... 412/38; 402/80 P; 402/60; 412/43

[58] Field of Search ..... 11/1 R, 1 MB, 1 A; 402/60, 63, 68, 80 P; 412/16, 33, 38, 43

[56] References Cited

U.S. PATENT DOCUMENTS

| | | | |
|---|---|---|---|
| 88,369 | 3/1869 | Covert . | |
| 150,740 | 5/1874 | Baird . | |
| 277,456 | 5/1883 | Cagney . | |
| 989,100 | 4/1911 | Wurzner . | |
| 1,040,506 | 10/1912 | Byron | 402/63 |
| 1,697,737 | 1/1929 | Roe . | |
| 1,841,989 | 1/1932 | Smith . | |
| 1,995,596 | 3/1935 | Adamson | 281/21 A |
| 2,206,394 | 7/1940 | Farkas | 281/21 A |
| 2,239,036 | 4/1941 | Farkas | 11/1 A |
| 2,709,290 | 5/1955 | Rosenthal | 85/DIG. 2 |
| 3,260,264 | 7/1966 | McKowen | 402/22 |
| 3,452,376 | 7/1969 | Ito | 11/1 R |
| 3,475,775 | 11/1969 | Staats | 11/1 AC |
| 3,596,929 | 8/1971 | Abildgaard | 281/21 R |

FOREIGN PATENT DOCUMENTS

| | | | |
|---|---|---|---|
| 116225 | 12/1942 | Australia . | |
| 121773 | 4/1946 | Australia . | |
| 157636 | 7/1954 | Australia . | |
| 235967 | 10/1961 | Australia . | |
| 250338 | 3/1964 | Australia . | |
| 61789 | 5/1964 | German Democratic Rep. | 402/68 |
| 741176 | 2/1933 | France | 402/47 |
| 837888 | 5/1938 | France | 402/80 R |
| Ad.73145 | 9/1960 | France | 402/63 |
| 40-28866 | 4/1965 | Japan . | |
| 52488 | 5/1942 | Netherlands | 402/68 |
| 200616 | 7/1923 | United Kingdom . | |
| 203094 | 9/1923 | United Kingdom . | |
| 321594 | 11/1929 | United Kingdom . | |
| 470142 | 8/1937 | United Kingdom . | |
| 519400 | 3/1940 | United Kingdom . | |
| 587108 | 4/1947 | United Kingdom . | |
| 870006 | 6/1961 | United Kingdom . | |
| 950768 | 2/1964 | United Kingdom | 402/80 P |
| 956010 | 4/1964 | United Kingdom . | |
| 975183 | 11/1964 | United Kingdom | 402/80 P |
| 1093754 | 12/1967 | United Kingdom . | |
| 1095640 | 12/1967 | United Kingdom . | |

*Primary Examiner*—Paul A. Bell
*Attorney, Agent, or Firm*—Julian Caplan

[57] ABSTRACT

A bookbinding is provided by plastic studs which fit through holes vicinal one margin of each sheet and strips which are fixed to the ends of the studs. The studs may be formed integrally with one or, in alternating arrangement, with both strips and complementary holes formed in the matching strip or strips to receive the stud ends. Excess stud lengths are sheared and headed to lock the strips and interposed sheets in position. Both strips may be apertured and the studs inserted through the holes in the strips and interposed sheets, both ends of the studs being headed. To facilitate handling, strips may be assembled in cartridges or coils, and studs in rods or coils. For thicker books, strips are formed with flanges fitting behind the page margins. Spine concealing tapes and caps fit over or around the spine edges of the sheets.

12 Claims, 47 Drawing Figures

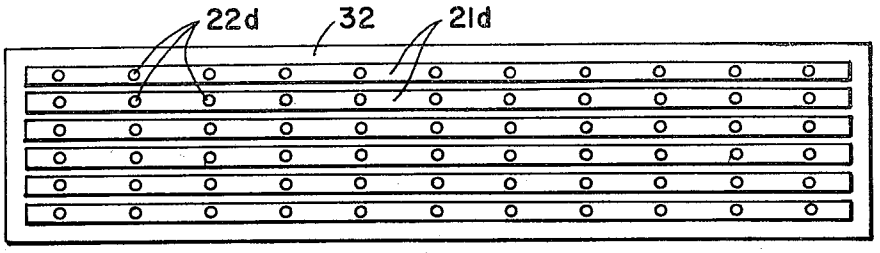
FIG. 7.
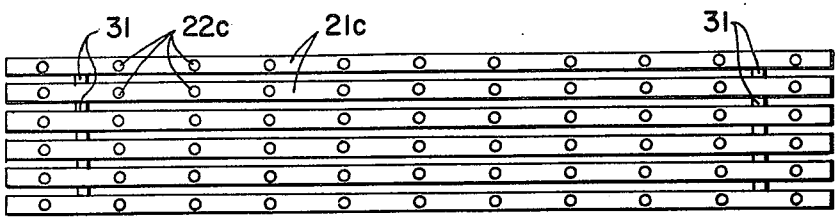
FIG. 6.
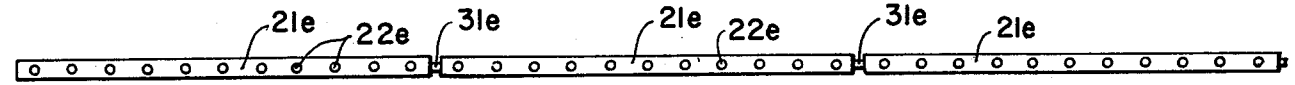
FIG. 8.
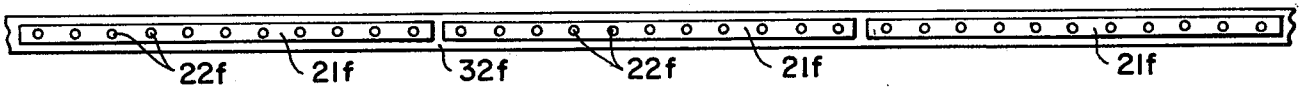
FIG. 9.
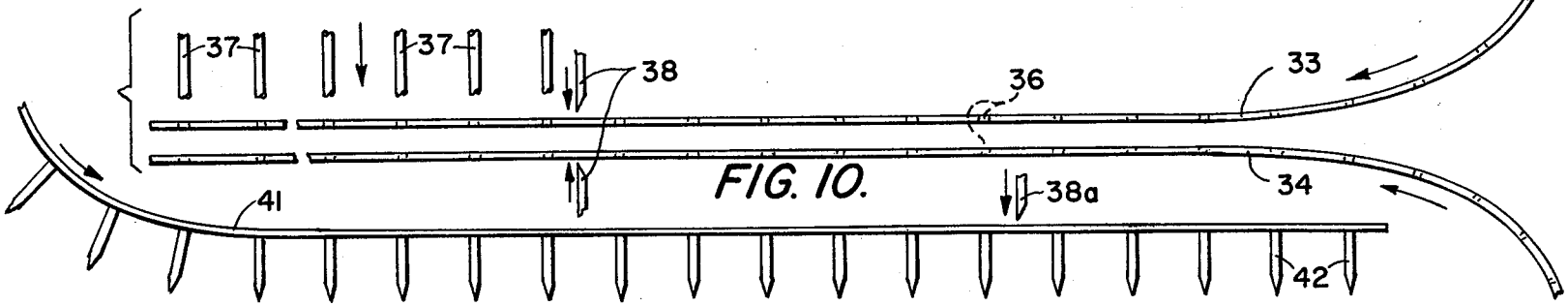
FIG. 10.
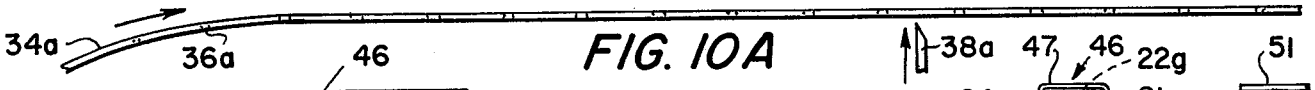
FIG. 10A
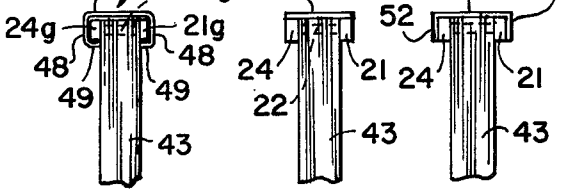
FIG. 12.
FIG. 13.
FIG. 13A.
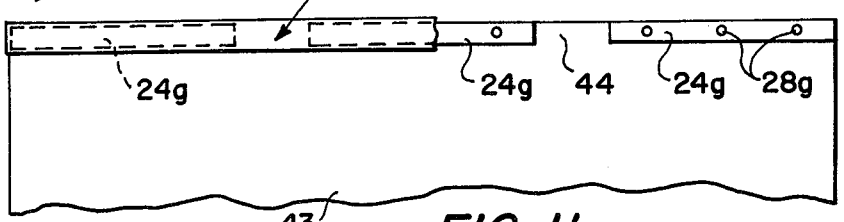
FIG. 11.

FIG. 14.
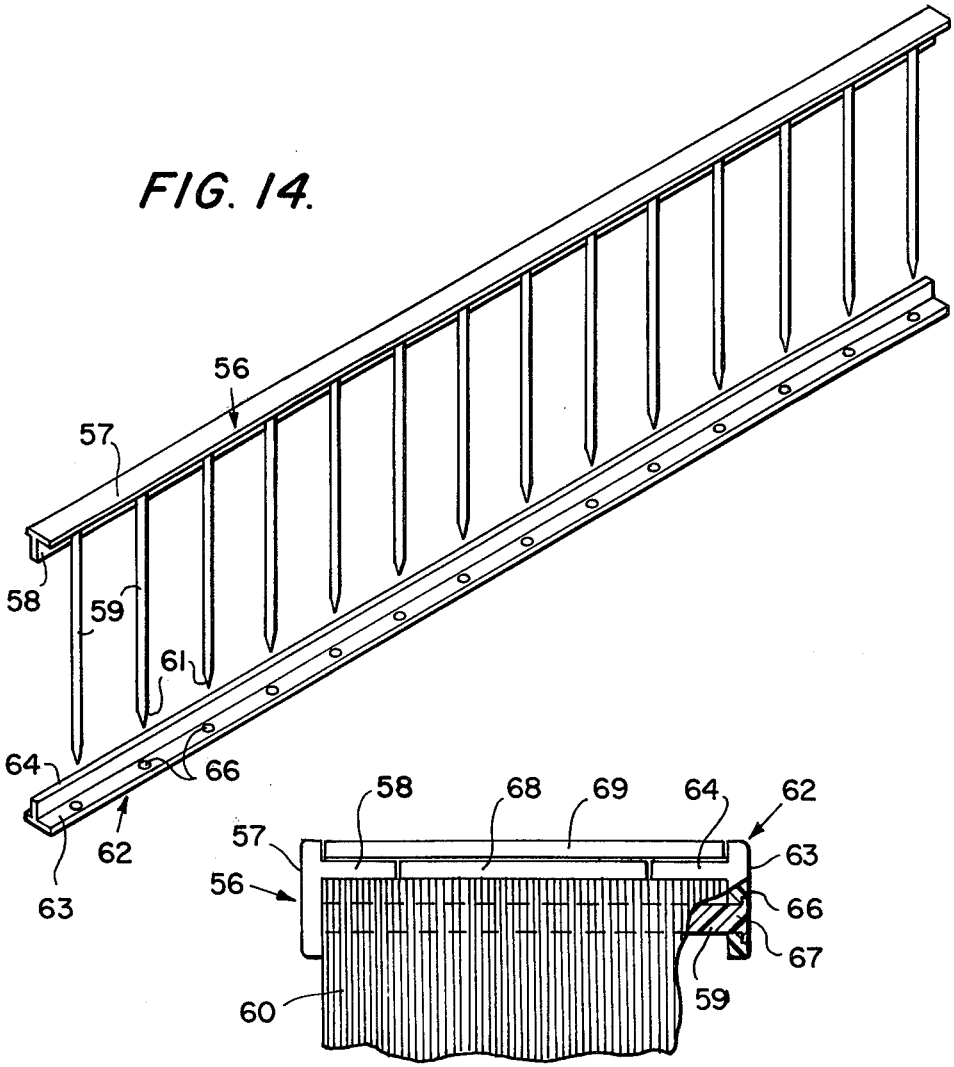
FIG. 15.
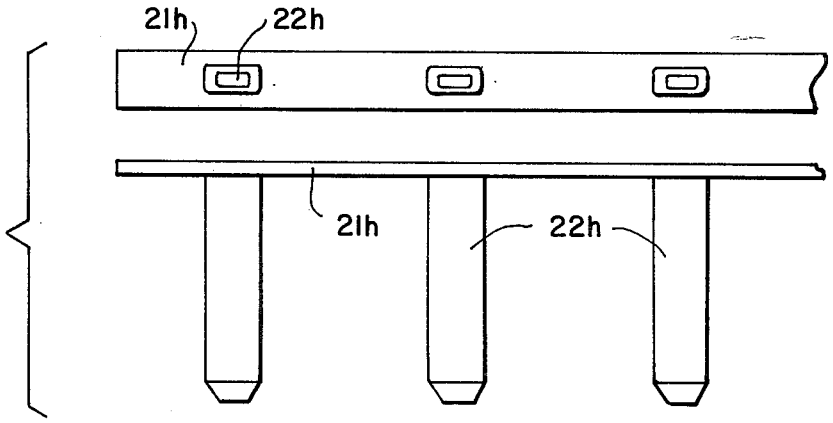
FIG. 16.

76
73
72
74

73
76
71b
60b
74

77
73
76
51b
60b
74
76

73
60b
77
51
71
74

125
126
124
127
128
123
40
39
197
198
196
121
122
123a
127a
162
163
166

BOOKBINDING STRIPS

This application is a continuation-in-part of copending application Ser. No. 710,185 filed July 30, 1976 (now abandoned), which was a continuation of Ser. No. 872,134, filed Oct. 29, 1969 (now abandoned), which was a continuation-in-part of Ser. No. 799,045, filed Feb. 13, 1969, which issued as U.S. Pat. No. 3,596,929 and is now Re. 28,202. The subject matter of Ser. No. 799,045 (now Re. 28,202) is incorporated herein by reference.

This invention relates to a new and improved binding for books and a method for forming same.

Heretofore various means have been used to bind books. One commonly used method is to sew the sheets together using sewing machines of various types. Such method is inherently slow and expensive. Another method has been the glueing of the spine ends of the sheets together and preferably to a tape. One disadvantage of such method is the fact that it requires time for the glue to set and further, that the binding is weak. A still further method has been stapling the sheets together with metal staples. Deficiencies of this method are the fact that the staples are only passed through sheets of limited thickness and cover only limited areas of the spine edges of the sheets and further, that the pages tend to tear. Rigid metal posts have been used in such books as accounting books of account but these have been very heavy and expensive books for looseleaf purposes. The present invention provides a binding which eliminates all the defects of previous systems which have heretofore been set forth. One of the advantages of the present invention is the fact that the binding may be used to accommodate considerable variations in thickness of sheets and works as effectively whether the book bound is thin or thick.

Another advantage of the present invention is the fact that the binding operation may be performed with very simple equipment and with relatively unskilled labor. Pre-punched sheets receive studs which are inserted through the holes in the sheets and through holes in strips which lie along the spine edges of the sheets. The equipment used merely shears off the excess length of the studs depending upon the thickness of the book and then forms a head on the severed end of the stud which retains the assembled book in position.

The present invention is adapted for use with a simple, desk-type piece of office equipment. Use of such equipment is relatively rapid and accommodates wide flexibility in the design of the treated book depending upon the choice of the customer. Thus colors, decor of cover pages, and the design of the covering of the spine of the book may be varied depending upon the taste of the customer.

A still further advantage of the invention is the fact that the studs, which are made of various types of plastic, may be sufficiently flexible to permit the binding to curve as do the highest grade sewn book bindings and this facilitates exposure of the portions of the sheets which lie close to the spine.

Although the binding is, as has been stated, adapted to simple office equipment, nevertheless it is also adapted to more sophisticated equipment involving repetitive operations and higher speeds. Thus, the strips may be assembled and packaged in cartridges to fit into a machine without the necessity of manually positioning each individual strip. Alternatively, the strips may be formed in coils of a length sufficient to bind a number of books and such coils fit into the binding machine and are cut to length as required. Further, although in a simple form of the invention one of the binding strips is formed with studs which penetrate the holes in the sheet and also corresponding holes in the opposing strip, nevertheless both strips may be formed with holes and the connecting members furnished from rods or coils of plastic material fed into the machine manually or by mechanical means. Accordingly, although the present invention has a considerable advantage in that it is usable with very simple equipment, nevertheless it is also adaptable to commercial production of books.

Other objects of the present invention will become apparent upon reading the following specification and referring to the accompanying drawings in which similar characters of reference represent corresponding parts in each of the several views.

In the drawings

FIG. 6 is a plan view of a cartridge of strips joined side-by-side by connecting gate material;

FIG. 7 is a plan view of a cartridge of strips formed by temporarily causing the strips to adhere to a web;

FIG. 8 is a view of a cartridge of strips joined end-to-end by gate material;

FIG. 9 is a plan view of a cartridge of strips formed by temporarily causing the strips to adhere to a web of material;

FIG. 10 is a schematic view showing strips which have been prepared from coils of strip material severed to length with rods of stud material inserted through aligned holes in the strips;

FIG. 10A is a view similar to FIG. 10 showing the studs previously formed on one of the strips;

FIG. 11 is a fragmentary plan view of a book formed in accordance with the present invention showing intermittent placement of strips and also showing the application of a bound spine cover of channel shape;

FIG. 12 is an end elevation of the structure of FIG. 11;

FIG. 13 is an end elevation showing use of a tape to seal the spine edges of the sheets and strips;

FIG. 13A is a modification of the structure of FIG. 13;

FIG. 14 is a perspective view similar to FIG. 1 of a modified strip construction used particularly with thick books;

FIG. 15 is an end elevation, partly broken away in section, of a book formed of the strip material shown in FIG. 14 and showing foam tape used to fill the space between strips;

FIG. 16 is a view showing a modified stud construction wherein the studs are rectangular rather than round;

Figure 17:
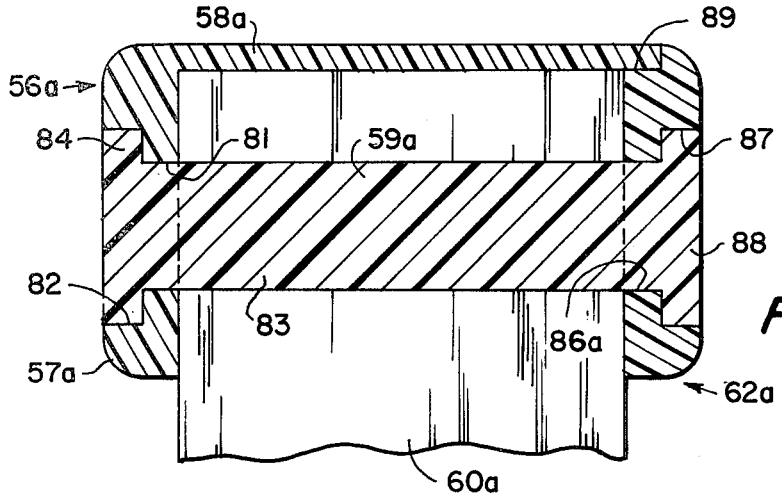
Figure 18:
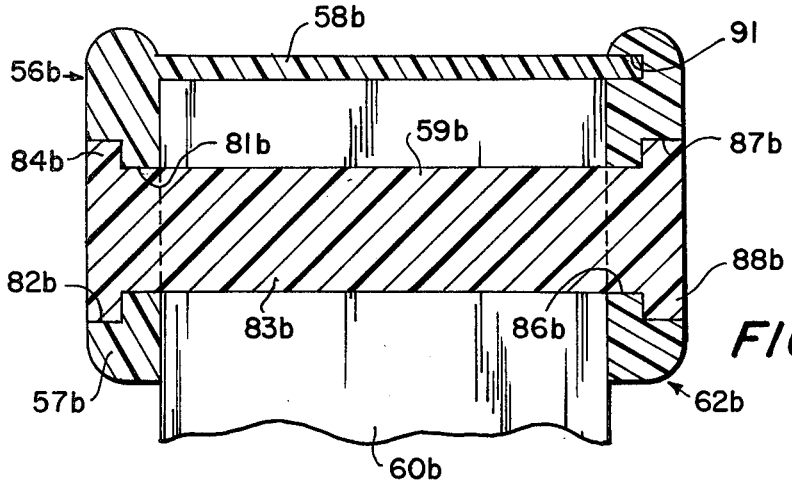
Figure 19:
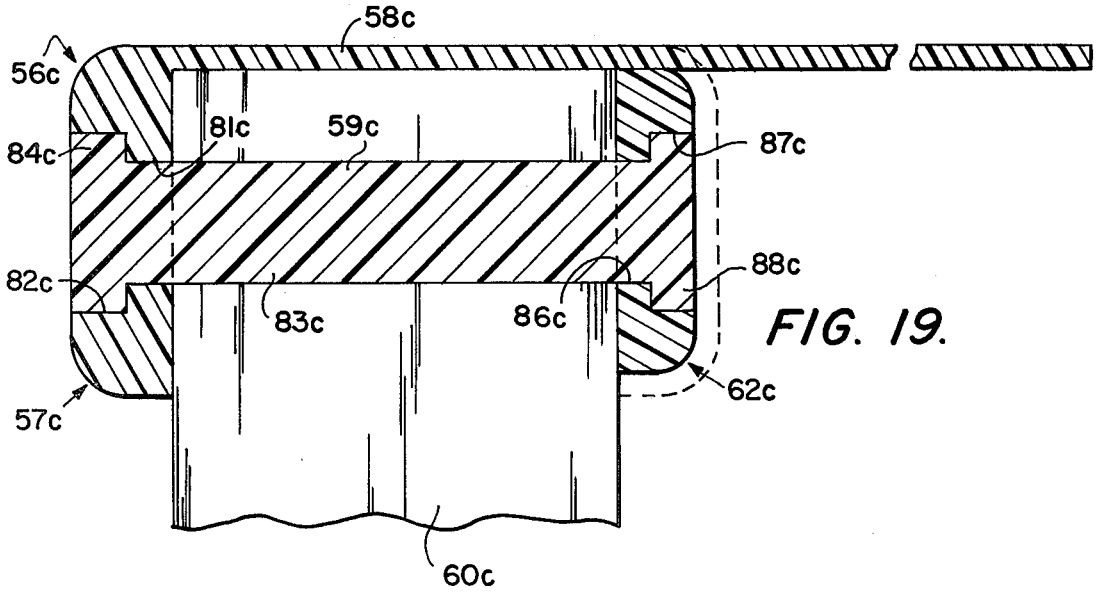
Figures 20, 20A, 20B, 20C:
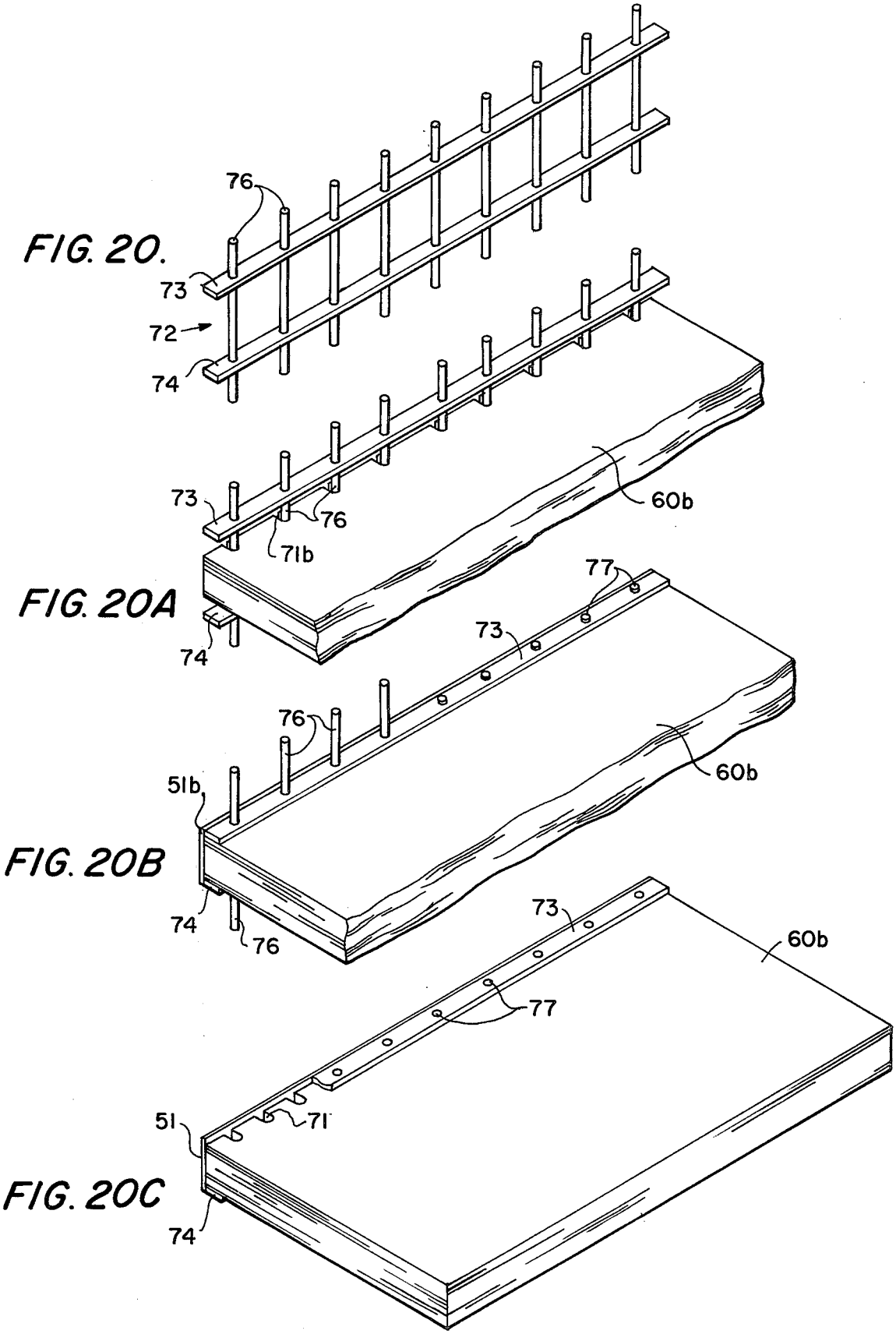

FIGS. 17–19, inclusive, are fragmentary sectional views similar to FIG. 15 of modified constructions;

FIGS. 20 to 20C, inclusive, are schematic fragmentary perspective views showing sequentially steps in the formation of a book in which the sheets have been notched rather than punched.

Figure 1:
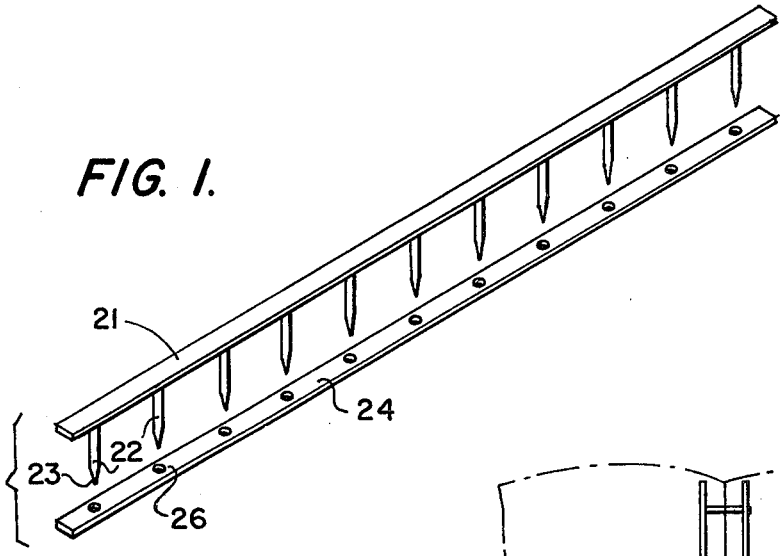
FIG. 1 is a perspective view showing two strips used in accordance with the present invention.
Figure 21:
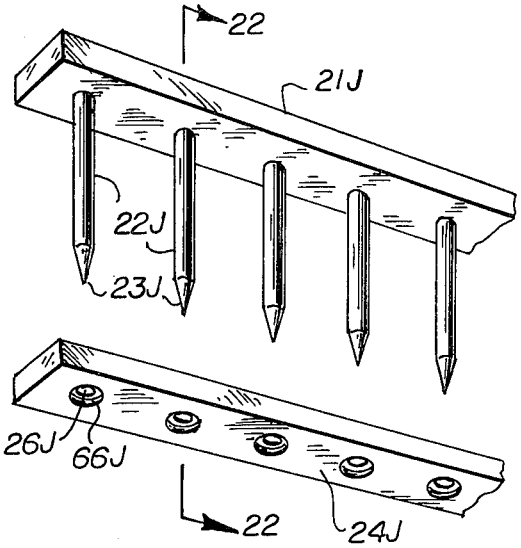

FIG. 21 is a perspective view of a pair of strips in accordance with FIGS. 1 and 15 prior to assembly in a book.

Figure 22:
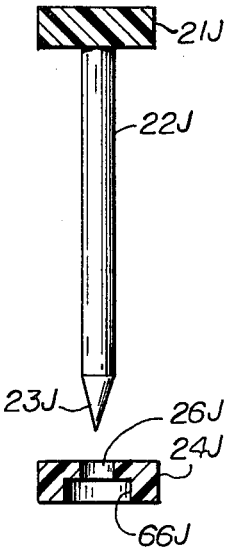

FIG. 22 is a sectional view taken substantially along the line 22—22 of FIG. 21.

Figure 23:
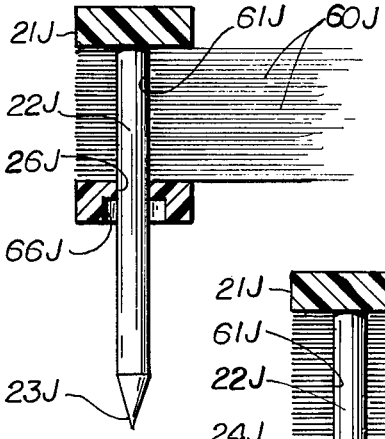

FIG. 23 is a view similar to FIG. 22 showing studs of one strip inserted through holes in sheets and the second strip with the strips compressed together.

Figure 24:
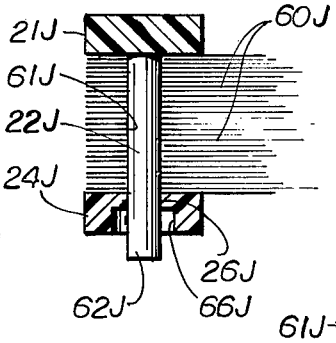

FIG. 24 is a view similar to FIG. 22 showing excess length of studs cut off.

Figure 25:
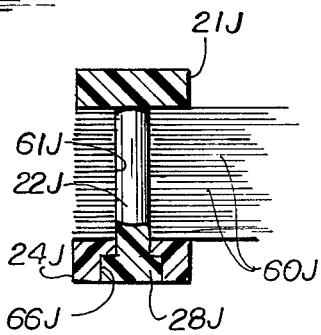

FIG. 25 is a view similar to FIG. 22 showing a head formed on the severed end of a stud.

Figure 26:
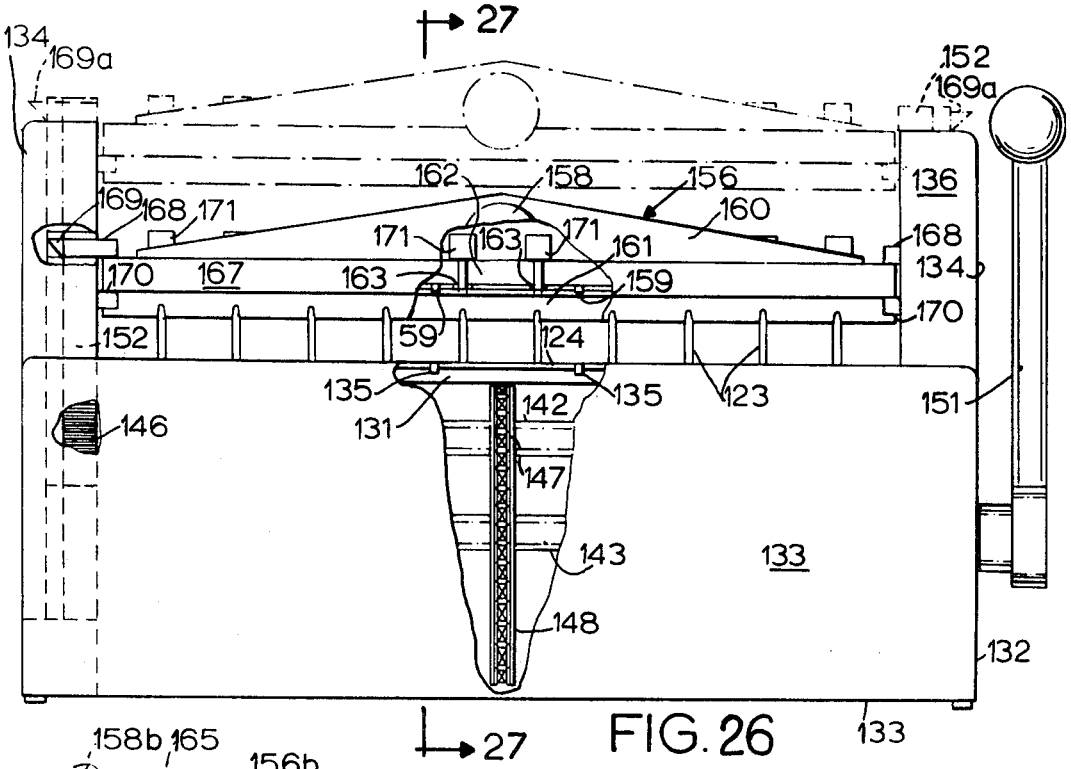

FIG. 26 is a front elevational view of one form of apparatus used in connection with the invention, partly broken away in section to reveal internal construction.

Figure 27:
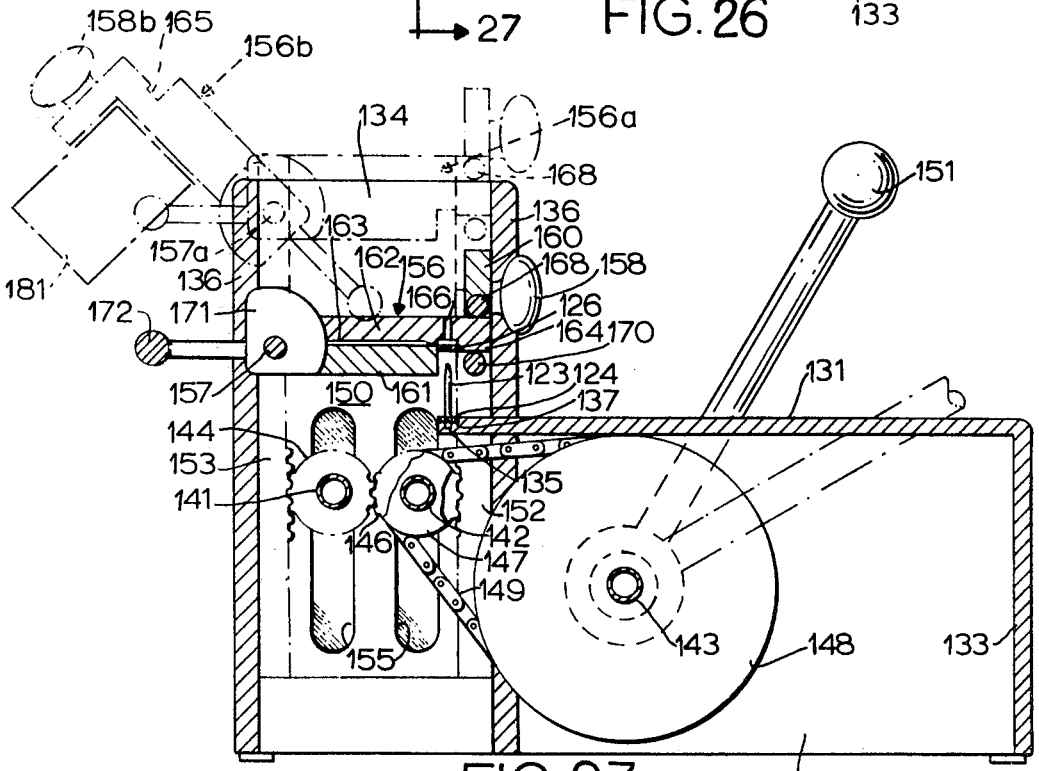

FIG. 27 is a vertical sectional view taken substantially along the line 27—27 of FIG. 26.

Figure 28:
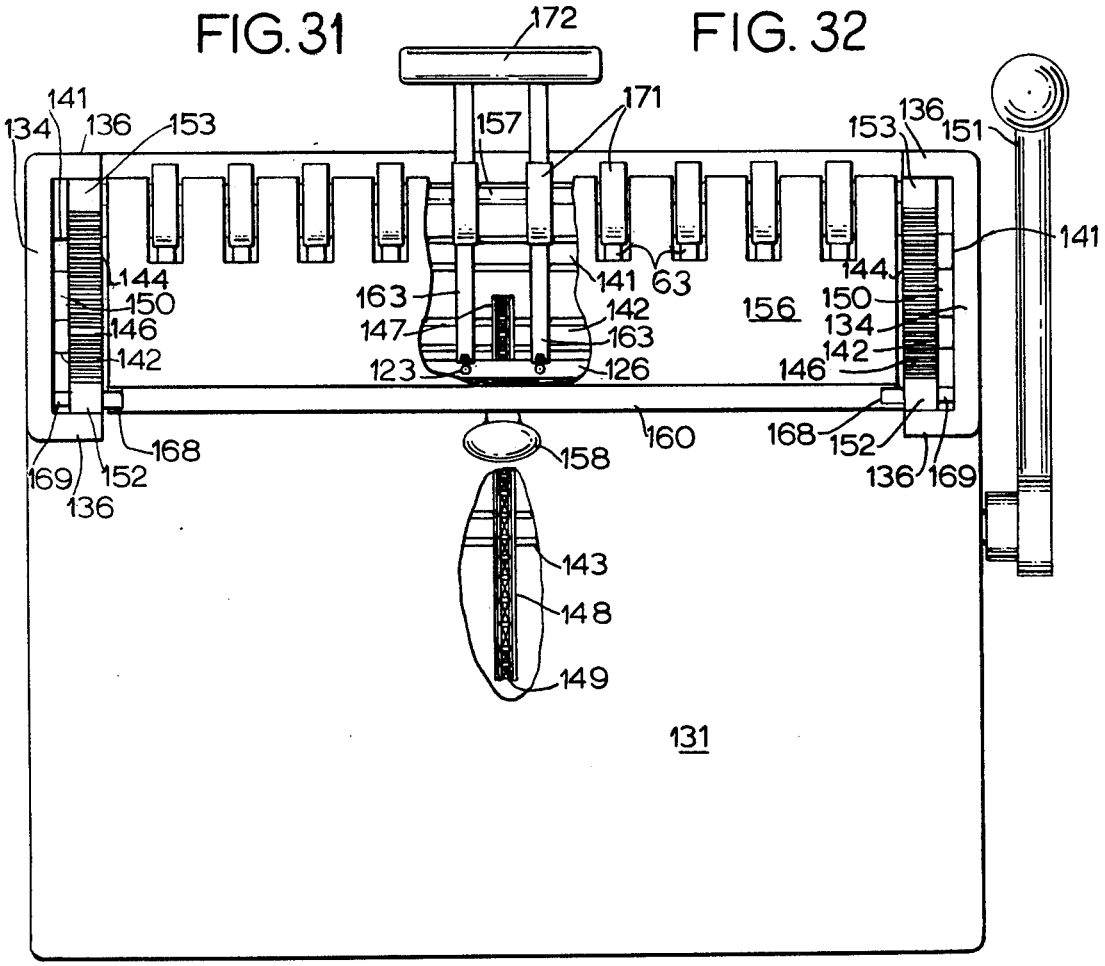

FIG. 28 is a top plan partly broken away in section to reveal internal construction.

FIGS. 29 to 32, inclusive, are fragmentary, enlarged schematic sections views showing means for more permanently binding the product together.

Figures 33, 34, 35, 36, 37, 38, 39, 40, 41:
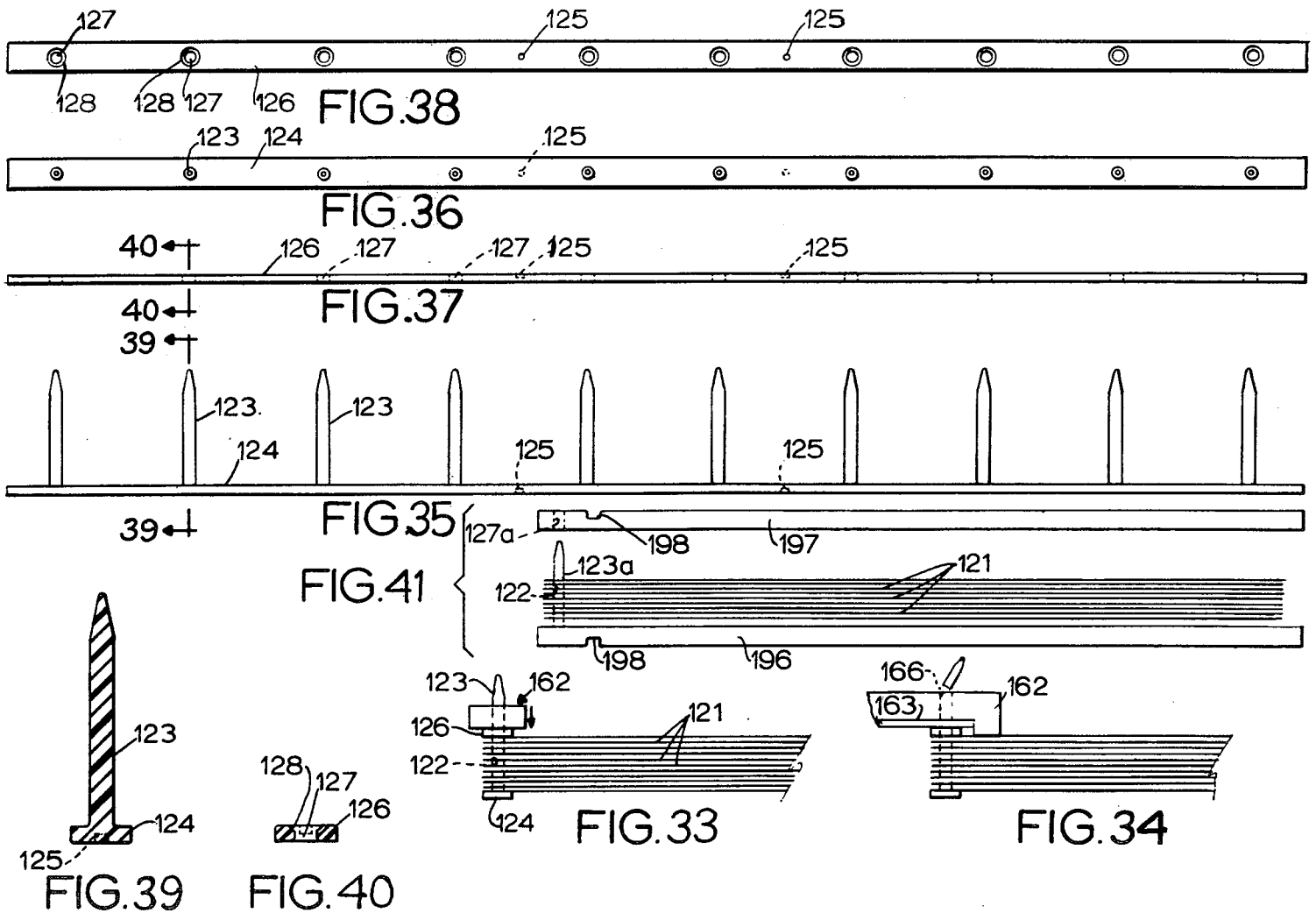

FIGS. 33 and 34 are schematic sequential steps in compressing and shearing methods performed by the apparatus.

FIG. 35 is a side elevational view of one of the strips used in forming the product.

FIG. 36 is a top plan thereof.

FIG. 37 is a side elevational view of another of the strips so used.

FIG. 38 is a top plan thereof.

FIG. 39 is an enlarged sectional view taken substantially along the line 39—39 of FIG. 35.

FIG. 40 is an enlarged sectional view taken substantially along the line 40—40 of FIG. 37.

FIG. 41 is an exploded side elevational view of a modified structure, similar to FIGS. 35 and 37.

Figure 2:
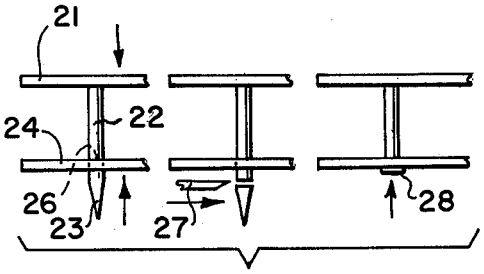
FIG. 2 is a schematic view showing steps in the compression of the strips, the shearing of the excess length of the studs, and the forming of a head on the end of the stud.

Directing attention first to FIGS. 1–3A, in one form of the invention there is provided a first strip 21 of plastic material having at equally spaced intervals along one side thereof a plurality of integral studs 22 each formed with a point 23. A matching plastic strip 24 is of approximately the same width and thickness as 21 and is formed at spaced intervals with holes 26. The spacing between holes 26 is the same as that between studs 22 and the size of holes 26 is sufficient to receive the studs with a sliding fit. In using the strips 21, 24, sheets of paper are formed with holes along one margin, preferably inward of said margin, the spacing between said holes being equal to the distance between studs 22. Apertured cover sheets (not shown) which may be specially colored and/or textured may be placed on the top and bottom of a stack of sheets. The sheets are assembled with the holes therein aligned and the studs 22 are inserted through the holes until the strip 21 is in close contact with the outermost sheet or cover. As shown at the left hand end of FIG. 2, stud 22 penetrates the hole 26 in strip 24 and its end projects beyond strip 24. Pressure is applied to compress strips 21 and 24 toward each other and thereby to compress the sheets through which the stud 22 extends together as well. As shown in the middle of FIG. 2, hot knife 27 or knife blade cuts off the excess length of stud 22 so that there is a slight protrusion thereof beyond the outer surface of strip 24. As shown in the right hand end of FIG. 2, pressure and/or heat is applied to the end of stud 22 to form a head 28 which locks the strips and the sheets therebetween in assembled position. In copending application Ser. No. 799,045, one form of apparatus forming the steps illustrated schematically in FIG. 2, is shown, but it will be understood that the particular mechanisms in said application are not exclusive.

Figure 3A:
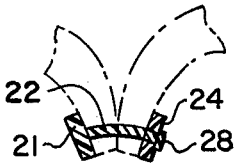
FIG. 3A is an enlarged sectional view taken substantially along the line 3*a*—3*a* of FIG. 3.
Figure 3:
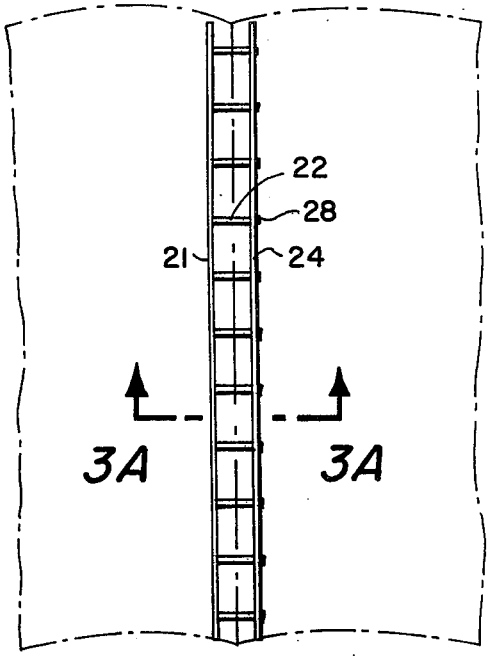
FIG. 3 is a schematic plan view of a book formed in accordance with the invention opened outwardly, the details of the book being shown in dot and dash lines.

In the phantom view shown in FIG. 3, the strips 21, 24 and studs 22 form a ladder-like assembly with the rungs or studs 22 penetrating the holes in the sheets. The binding is secure and also has certain flexibility as is shown in FIG. 3A. When the pages of the book are opened out, the studs 22 flex in an arc and the strips 21, 24 diverge outwardly-upwardly from straight parallelism while the spine edges of the sheets likewise curve upwardly. Thus, this binding method permits opening of the sheets in a manner similar to high class sewn binding.

Figure 4:
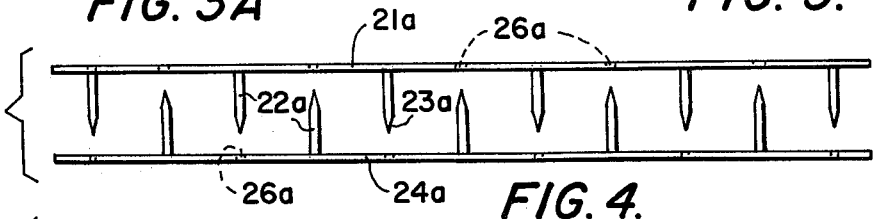
FIG. 4 is a side elevation of modified strips.

FIG. 4 is a variation of the structure of FIG. 1 and illustrates that some of the studs 22*a* may be formed on one of the strips 21*a* and other studs 22*a* on the companion strip 24*a* and that matching holes 26*a* may be formed in each of the strips.

Figure 5:
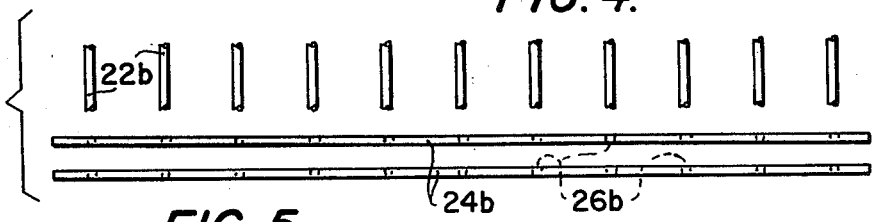
FIG. 5 is a side elevation of a pair of apertured strips and portions of rod material forming the studs.

FIG. 5 illustrates a further modification of the invention. Two apertured strips 24*b* are each formed with spaced holes 26*b*. The stud material 22*b* is supplied in rods or coils of sufficient length to accommodate fabrication of several books. The strips 24*b* are assembled on the outside of the stack of sheets with the holes 26*b* aligned with the holes in the sheets. Thereupon the stud material 22*b* is run through the hole 26*b* in the nearest strip 24*b*, thence through the aligned holes in the sheets and thence through the holes 26*b* in the farthest strip 24*b*. Thereupon heads (this is not shown) similar to heads 28 of FIG. 2, are formed on both ends of that portion of the stud material 22*b* which is cut to size, one head on the top of one strip 24*b* and one on the bottom thereof.

FIG. 6 shows a cartridge arrangement for strips 21*c*. Actually these strips 21*c* may resemble the strips 21 or 24 of FIG. 1 or the strips 21*a* or 24*a* of FIG. 4 or the strips 24*b* of FIG. 5. The strips 21*c* are parallel to each other and are connected to each other by gate material 31 of the type commonly produced in plastic molding operations. The cartridge of FIG. 6 may be installed in a machine for performing the operations illustrated schematically in FIG. 2, it being understood that one of the strips 21*c* is used to bind one book and then the next strip used to bind the next book, the gate material 31 being discarded as each strip is used.

FIG. 7 shows a cartridge similar to FIG. 6 except that a web 32 of paper or the like, having a tacky upper surface is used to hold the strips 21*d* in assembled position until they are used in binding a particular book. The strips 21*d* may be of the same type as the strips 21*c* of FIG. 6. It is to be understood that although in FIGS. 6 and 7, there are six strips shown, the number is subject to wide variation.

FIG. 8 shows strips 21*e* similar to strips 21*c* joined end to end by gate material 31*e*. These strips are fed longitudinally rather than transversely as in the two preceding modifications.

FIG. 9 shows a tape 32*f* of paper similar to the paper of FIG. 7 and has a series of strips 21*f* applied thereto in end to end relation. The strips 21*f* are similar to the strips 21*c*. The number of strips 21*e* or 21*f* which may be arranged end to end is likewise subject to variation.

FIG. 10 illustrates still another variation of the invention. Long coils of plastic material 33,34 each formed with spaced holes 36 are fed lengthwise into a machine and located with their holes 36 aligned and also in alignment with the holes of the sheets to be bound. Corresponding numbers of stud material 37 in the form of rods or coils of material are fed by means forming no part of this invention through the holes 36 in the top strip 33, thence through the holes in the sheets and out through the holes in the bottom strip 34. The strips 33,34 are cut off by knives 38 or other means so that their overall length corresponds to the length of the pages being bound. Heads may be formed on the stud material 37 in the same manner as described with reference to FIG. 5.

In FIG. 10A the bottom strip 34*a* is similar to the strip 34 of FIG. 10 and is formed with holes 36*a* at spaced intervals. The mating strip 41 is formed at equally spaced intervals with integral or previously assembled studs 42 similar to studs 22 of FIG. 1. Blades 38*a* cut the strips 34*a*, 41 to length and the excess length of studs 42 are sheared off as in the preceding modification of FIG. 2 and heads (not shown) are formed on the ends of these studs to secure the parts in assembled position.

In the preceding modification it has been assumed that the strips extend continuously from top to bottom of the book being formed. FIG. 11, however, illustrates that, by any of the means previously described, intermittent strip sections 24*g* may be spaced along the length of a cover or sheet 43. As shown here, there are three stud heads 28*g* formed in conjunction with each strip 24*g*, but it will be understood that this number is subject to wide variation and that the relative proportion of strip length 24*g* to the gaps 44 therebetween is likewise subject to variation. Although not shown, there is a corresponding strip 21*g* of the same length as strip 24*g* on the bottom of the stack of sheets shown in FIG. 11. To finish off and make more secure and rigid the structure of FIG. 11, a channel shaped plastic spine cap 46 is slid endwise over the assembled book. As shown in FIG. 12, cap 46 has a base 47 spanning the distance between the outer surfaces of strips 21*g*, 24*g*, has inturned sides 48 of the width of strips 21*g*,24*g* and inturned lips 49 of the thickness of strips 21*g*,24*g*. Various means may be used to retain the cap 46 in position such as an adhesive. The width of space 47 will accommodate a variation in book thicknesses and may be heat shrunk to size after assembly, if desired.

Directing attention to FIG. 13, a book comprising sheets 43 held together by strips 21 and 24 with studs 22 passing through apertures in the sheets may be finished off at the spine by means of a strip 51 of a tape such as pressure-sensitive tape which adheres to the exposed edges of the sheets 43 and also to the edges of the strips 21 and 24. In FIG. 13A, the tape 51*a* lies along the spine of the book but is of a sufficiently greater width so that edges 52 thereof may be folded over to cover strips 21 and 24. The folded over portions 52 conceal the heads of the studs and may be preferred for additional reasons by some customers. The cap 46, tape 51 or 51*a* may be marked with various ornamentations and legends such as book titles, if desired.

FIGS. 14 and 15 show modified strip constructions and spine finishing means particularly useful for thick books such as books which are more than approximately one inch thick. Strip 56 is molded with a flat outside flange 57 and an inward directed flange 58 extending at right angles thereto. Studs 59 which are similar to but longer than studs 22 of FIG. 1 and also preferably more flexible, project from flange 57 about midway between flange 58 and the inner edge of the strip. Studs 59 may be formed with points 61 to facilitate penetration of the holes in the sheets 60 which are to be bound. The matching strip 62 has an outside flange 63 dimensioned similar to flange 57 and an inward projecting flange 64 at right angles thereto which is similar to flange 58. Countersunk or counterbored holes 66 are formed in flange 63 complementary to the positions of studs 59. When the book is assembled as shown in FIG. 15, the flanges 58 and 64 lie against and help to support the spine edges of sheets 60. Studs 59 penetrate the holes in the sheets 60 and also holes 66 and a head 67 is formed on the severed end of the stud filling the countersunk or counterbored hole substantially the same as in the preceding modification. To finish off the spine edge, a first strip 68 of a foam-type pressure-sensitive tape is slit to a width equal to the distance between the inner edges of flanges 58 and 64 and adheres to the exposed spine edges of the sheet 60. To further finish the spine binding, a second piece 69 of tape similar to the piece 68 but of a width equal to the distance between flanges 57 and 63 is applied as shown in FIG. 15. Suitable decorations and legends may be applied to the exposed surface of tape 69. It will be seen that the thickness of tape 68 is equal to the thickness of flanges 58 and 64 while the thickness of tape 69 is equal to the distance between the outer edge of flange 58 and the outer edge of strip 57. As shown, these two thicknesses are the same, although this is not necessary to the invention. Tapes 68 and 69 may be formed integral.

It will be understood that the arrangement of studs 59 and holes 66 on the strips 56 and 62 is subject to variation as will be understood from an examination of FIGS. 4 to 10A inclusive. Studs 59 may initially be separate from flange 57 and installed as in FIGS. 5 and 10.

A modification of the form of the invention of FIGS. 14 and 15 is shown in FIG. 17. It will be understood that the structure of FIG. 15 may be modified by omitting the tape sections 68 and 69 but if this is done, then the spine edge of the completed book is unsightly. To eliminate such unsightliness without requiring the use of tape, strip 56*a* is molded with inward directed flange 57*a* and an outside flange 58*a* of extended length which is formed at the outer edge of flange 57*a*. Appropriate studs 59*a* are connected to strip 56*a*. Because of the difficulty of molding the flanges 57*a*, 58*a* and studs 59*a* all in one piece, it is preferable, although not essential, that the strip 56*a* initially be formed with holes 81 at spaced intervals along its length and preferably that said holes be formed with counterbores 82 on the outside surface of flange 57*a*. Rod-like stud material 83 is then inserted through hole 81, such material preferably having a head 84 formed thereon which seats in counterbore 82. It will be understood, however, that head 84 may be formed on the rod-like stud 83 after the latter has been inserted through hole 81 or that the head may be formed at the time that the stud is locked through the opposite strip 62*a* when the book is in the course of fabrication.

Matching strip 62a is formed with a series of holes 86 which are complementary to studs 83, said holes preferably being formed with counterbores 87 on the outside surface for the formation of heads 88 during the course of fabrication of the book. A notch 89 is formed on the outer edge of the inside surface of strip 62a to receive the end of flange 58a. Thus, in the assembly of the book, each stud 83 is inserted through a hole 86 in strip 62a, the excess stud material being cut off and a head 88 formed filling the counterbore 87. At the same time, the end of flange 58a is trimmed to appropriate length so as to seat in notch 89.

As shown in FIG. 18, strip 56b is similar to that of the preceding modification. The outer flange 58b is spaced slightly inward from the outside edge of flange 58b. The matching strip 62b is formed with a groove 91 in the inside surface spaced inward from the edge of said strip to receive the end of flange 58b. In other respects, the modification of FIG. 18 resembles that of the preceding modification and the same reference numerals followed by the subscript b are used to designate corresponding parts.

In the modification of FIG. 19, the outside flange 58c is positioned at the outer edge of flange 57c and is of considerably extended length. Strip 62c is not formed with grooves or notches corresponding to the elements 89 or 91 of the preceding modification. When the book is assembled, flange 58c is bent over the outside of the strip 62c and turned inward to lock against the inner edges of strip 62c. This arrangement finishes off the structure of FIG. 19. Much of the structure is similar to that of the two preceding modifications and the same reference numerals followed by the subscript *c* are used to designate corresponding parts.

The studs 22 and 59 have been illustrated and described as being small diameter round members. However, FIG. 16 shows that the cross section of the studs 22h of strip 21h may be rectangular and, of course, the holes in the mating strip are similarly rectangular. A commonly used binding system punches rectangular holes along one margin of the sheets to be found using a quite different plastic "comb" to penetrate the holes and bind the sheets together. By forming strip 21h with studs 22h the system of the present invention may be used with sheets punched with rectangular holes. Although the studs 22h are shown projecting from strip 21h, it will be understood from examination of FIGS. 1–10A and FIGS. 14 and 15, that the positioning of the studs and the construction of the strips is subject to considerable variation. Studs 22h may initially be separate from strips 21h and may be installed therein by means and method similar to FIGS. 5, 10 and 20–20 C.

In the preceding description it has been assumed that pages 60 are punched with round holes faced inward from the edge of the sheet. However, as shown in FIG. 20C notches 71 may be formed in the edges of 60a. Such notched sheets are currently used extensively in looseleaf accounting forms. Strip 73j and the corresponding stud-carrying strip 74 when pressed firmly together with head 77 formed on the severed ends of the studs will securely retain sheets 60a in place even though the notches 71 permit the sheets to be slid into and out of engagement with the studs prior to binding. In this version of the invention, a pressure-sensitive tape 51 may be applied to the spine edge of the completed book for identification purposes, and to further secure the notched pages from sliding free. This makes the system particularly adapted to use by accountants wherein ledger sheets are initially looseleaf while the books of account are "open" and then are securely bound together once the books are "closed".

An adaptation of this system is shown in FIG. 20 to 20B. A "comb" is initially provided for use with sheets 60b formed with notches 71b at one margin. Comb 72 may consist of two apertured strips 73, 74, the distance between the apertures therein equalling the distance between notches 71b, and a plurality of rods 76 penetrate the apertures in both strips and project outward on either side therethrough. The strips 73 slide relative to rods 76 with a fairly close fit so that rods do not fall out of the strips, but when sufficient pressure is applied, the strip 73 or 74 slips along the rods. When the sheets 60b are ready to be bound, they are slid endwise so that the rods 76 enter the notches 71b. Until heads are formed on the rods 76, the comb functions as a looseleaf holder for sheets 60b since strip 73 may be slid toward and away from strip 74 to increase or diminish the pressure tending to hold the sheets in place. This is illustrated schematically in FIG. 20A. When it is desired to bind the sheets together, strips 73,74 are pressed tightly together and the ends of rods 76 which project beyond the strips are cut off and formed with heads 77 permanently locking the sheets 60b in place. A tape 51b inscribed with suitable legend to identify the sheets or for other purposes may be applied to the exposed spine edges.

It will be understood, although not shown in detail, that the rods 76 need not project through both strips 73 and 74 but may be formed integrally and projecting only from one side of one of the strips as in FIG. 1 and that the arrangement of studs and the shape of the strips is subject to wide variation as is shown in FIGS. 1–10A, 14 and 16. As used in the claims, the term "effective length" in referring to the studs means the portion used for actual binding, up to but not including the tapered point 23.

Directing attention now to FIG. 21, the male strip 21j is substantially the same as the corresponding male strip in FIG. 1. The female strip 24j is formed with holes 26j having the same spacing as the studs 22j and dimensioned to receive the same with a sliding fit. Depressions 66j or counterbores are formed in the outer surface of strip 24j surrounding the holes 26j similar to the counter sunk or counter bored holes 66 described in connection with FIGS. 14 and 15.

In use of the structure shown in FIGS. 21 and as illustrated in FIGS. 22–25, inclusive, sheets 60j of paper or similar material formed with holes 61j are positioned in apparatus such as described in connection with FIG. 2 with the holes 61j in registry with the holes 26j. The tapered ends 23j of the studs 22j are inserted through the apertures 61j and 26j and pressure is applied to compress the strips 21j and 24j together, the sheets 60j therebetween likewise being compressed. Completion of this step is shown in FIG. 23. Thereupon, by means of a knife, which may also be heated, the excess lengths of the studs 22j are cut off leaving stubs 62j protruding below the bottom surface of strip 24j. Thereupon a head 28j is formed on the stub 62j, filling the counterbore or depression 66j. Alternatively, if the extra holding power of the head 28j is not required and frictional holding is adequate for the document being bound, the stud 27j may be cut flush with the outside surface of strip 24j. In this modification, the depression 66j which in the preceeding modification receives the head 28j is not required.

The apparatus hereinafter described and illustrated in FIGS. 26–32 is used to bind together sheets of paper or the like which are designated in the accompanying drawings generally by reference numeral 121. Each sheet is formed with a series of spaced holes 122 along one margin thereof, the spacing intervals between the holes corresponding to the spacing of integral solid studs 123 integral with first strip 124, hereinafter described. The holes 122 may be made by means of a paper punch. Occasionally, it is desirable to cover a book such as a paperbound book. Where the thickness of the book makes punching unsatisfactory, holes 122 may be drilled. The dimensions of the pages 121 which are accepted by the apparatus hereinafter described are subject to considerable variation, the apparatus being made large enough to accommodate a range of sizes, although a length of page of 11 inches is standard. The thickness of the sheets which are to be bound is likewise subject to variation between a very few sheets and a thickness of sheets which is within the limits of the length of the studs 123 of the strip 124. Used in conjunction with strip 124 is a second strip 126 having a series of holes 127 formed therein which correspond in spacing to the distance between studs 123. The diameter of the holes 127 is preferably slightly less than the diameter of the studs 123 so that when the product is assembled, the parts will be held in frictional engagement against reasonable stress. As hereinafter appears, in some of the more permanent means of bonding the strips 124, 126 together, a counter sink 128 may be formed in one surface of strip 126 at each hole 127.

The length of strips 124 is subject to variation, but where 11-inch pages are being bound, the overall length is preferably 11 inches, although an overlap may be provided where a cover larger than the pages is used. The strips are advantageously molded or otherwise formed of a plastic material. One suitable material is a rigid polyvinyl chloride which is thermoplastic. Polystyrene is also suitable for such strips. In permanent bonding, it is desirable, as hereinafter appears, to distort the ends of the studs 123 after they have been sheared off by heat either by direct application of a hot iron or by spinning. Further, it is sometimes possible to distort the end of the stud by cold forming as by swagging. The plastic elected should be suitable for such purposes. To facilitate locating strips 124, 126 in the apparatus, as hereinfter explained, depressions 125 are formed in the underside of said strips at fixed locations.

The apparatus used is preferably suitable for installation on an office desk and hence is relatively small and compact. A horizontal table 131 is provided having depending sides 132 and a front 133. The top inner edge of the table 131 is provided with a transverse ledge 137 dimensioned to receive strip 124 with studs 123 extending upward. Pins 135 fit into depressions 125 in strip 124 to locate same longitudinally. The back end of table 131 are side pieces 134 which project above the table 131 and have inward turned marginal flanges 136. Extending between sides 134 below the level of table 131 are horizontal transverse shafts 141, 142 and forward of shafts 141, 142 is transverse shaft 143. At either end of shafts 141, 142 are matching spur gears 144, 146 respectively. At its center, shaft 142 carries sprocket 147 and shaft 143 carries sprocket 148. Sprockets 147, 148 are interconnected by chain 149. Outside the right-hand side 132 is handle 151 on shaft 143. When handle 151 is pulled forwardly, gears 144 are caused to revolve. On either side of the machine reciprocating vertically within members 134 are front and rear racks 152, 153 respectively, which mesh with gears 144, 146, and are interconnected by vertical plates 150 formed with elongated vertical slots 155 through which shafts 141, 142 extend. Hence, when handle 151 is moved, the turning of gears 144, 146 causes the racks 152, 153 to reciprocate vertically in unison.

Press block assembly 156 is pivoted by means of horizontal transverse shaft 157 to the rear racks 153. Press block 156 in its operative position is shown in full line in FIG. 27. When the handle 151 is turned so that the racks 152, 153 are fully elevated, the shaft 157 assumes the position indicated by reference numeral **157*a* in FIG. 27. When thus located, the handle 158 attached to upstanding flange 160 on the front of assembly 156 is pushed rearwardly to the dotted line position shown by reference numeral 158*b*, at which position the assembly 156 is fully retracted. In fully retracted position, ledge 137 is exposed for installation of strip 124 and the pages 121 are installed in position over the studs 123 or such installation may be previously performed and the pages and strip 124 installed as shown in FIG. 27**.

Assembly 156 has a lower part 161 and an upper part 162 separated by openings within which reciprocate shearing blades 163. Part 161 terminates immediately inside ledge 137 in the operative position of the device to provide a recess 165 for strip 126 between the inner edge of plate 161 and a lip 164 projecting down from the forward edge of plate 162. Pins 159 fit into depressions 125 in strip 126 to locate same accurately in position relative to strip 124. Holes 166 are formed in plate 162 in alignment with studs 123.

Forward rack 152 carries a pin 170 upon which ledge 164 rests in the operative position of press block assembly 156. Rack 152 also carries a horizontally reciprocating detent 168 which engages the top of flange 167 in the operative position. The outer end 169 of detent 168 is bevelled and is biased outwardly by a spring (not shown). In the upper position of the press block assembly indicated by reference numeral **156*a* in FIG. 27, the detent 168 is projected outwardly so that its end 169*a* overhangs the upper edge of member 134 and its inner end clears flange 167. Hence, the assembly 156 can be pivoted counterclockwise as indicated in FIG. 27 by reference numeral 134 and its inner end clears flange 167. Hence, the assembly 156 can be pivoted counterclockwise as indicated in FIG. 27 by reference numeral 156*b* to fully retracted position. When the assembly 156*a* is pivoted clockwise from the position 156*b* to the position 156*a* and is depressed, the end 169 engages the upper edge of side piece 134 and is pressed inwardly. Thereupon the detent 168 engages the top of lip 167, locking the assembly 156 for movement with the racks 152, 153**.

The handle 151 is turned clockwise as viewed in FIG. 27 until the assembly 156 is lowered so that the tops of the studs 123 enter the holes 127 of strips 126 and the movement is continued until the paper 121 is compressed between table 131 and lip 164. Shaft 157 carries a plurality of cams 171 which engage the ends of shearing blades 163 reciprocating between parts 161, 162 and biased by springs (not shown) to inoperative position. Certain of the cams 171 are connected to handle 172. When handle 172 is pulled forwardly, the cams 171 cause the blades 163 to move inwardly and to shear off the ends of studs 123 above the level of strip 126.

The sequence of operation of the apparatus shown in FIGS. 26–28 is as follows: The press block assembly is in open position as indicated by reference numeral 156b in FIG. 27. Strip 124 is installed on ledge 137 with studs 123 uppermost. The paper 121 is inserted over the studs 123, it being understood that this operation may be performed before the strip 124 is installed. The assembly 156b is pulled forward to the position indicated by reference numeral 156a by grasping the handle 158. Thereupon the ends 169 of detent 168 are pushed inwardly as the press block assembly and racks 152, 153 move downward so that the detents 168 engage the tops of lip 167, locking the assembly 156 for movement with the racks 152, 153. Handle 151 is pulled in a clockwise direction, causing the assembly 156 to be lowered so that the upper ends of studs 123 enter the holes 127 and then penetrate the holes 166. This movement is continued unitl the paper is compressed, between table 131 and lip 164. In other words, the studs 123 extend as far as possible through the holes 127 in strip 126, commensurate with the thickness of pages being bound. Thereupon, the shear handle 172 is pulled forwardly, cams 171 causing the blades 163 to shear off the ends of studs 123 above strip 126 (see FIG. 34). Handle 172 then returns to initial position. Handle 151 is also returned to initial position, causing the press block 156 to rise to upper position where it is then opened by pivoting backward so that the bound pages can be removed.

Figure 29:
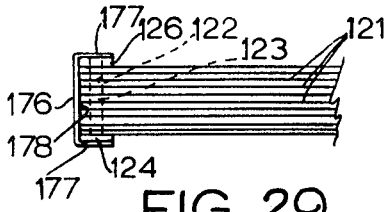

The foregoing operation causes friction engagement of strip 126 with the studs 123 of strip 124. One means of more permanent attachemnt is shown in FIG. 29. A longitudinally extending edge cover strip 176 of flexible material covers the exposed edges of sheets 121 adjacent holes 122. The edges 177 at top and bottom are bent at right angles over the exposed surfaces of strips 124, 126. Various means may be used to bond the edges 177 to strips 124, 126 as by various adhesives, such as glue 178. However, the strip 124 carrying studs 123 and the cooperating apertured strip 126 provide the sheet clamping and binding structue.

It will be noted that the clamping strips extend along the length of the clamped margin of the book, and are substantially even or flush with the side edge of such clamped margin. Consequently, the strips reinforce and provide a protecting shield for the clamped side edges of the sheets, to prevent tearing or other damage which might otherwise occur by exposed sheet edges rubbing against objects. Furthermore, even though the studs are spaced apart, since they are rigidly secured to one strip and engage in the holes of the other strip, the clamping pressure is distributed uniformly over the entire length of the rigid plastic strips. This results in rigidity against transverse bending of the book in the spaces between the studs, that would otherwise occur if only studs without the strips were employed.

Figure 31:
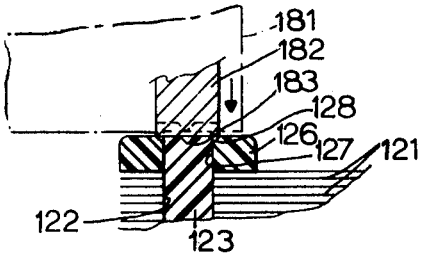

FIG. 31 shows a means for cold forming the ends of studs 123. An attachment indicated generally by reference numeral 181 is connected to press block assembly 156 (see FIG. 27), attachment 181 carrying a plurality of reciprocating punches 182 corresponding in spacing and number to the studs 123. The outer ends of punches 182 have conical points 183 which penetrate the sheared ends of studs 123 and deform them outwardly. Particularly where holes 127 are formed with counter sinks 128, such outward deformation locks the sheared ends of studs 123 to strip 126 in permanent fashion. The details of construction of attachment 181 will readily occur to one skilled in this art. Reciprocation of punches 182 may be manually or automatically accomplished by means forming no part of the present invention, the operation being performed after the shear blades 163 have returned to inoperative position.

Figure 30:
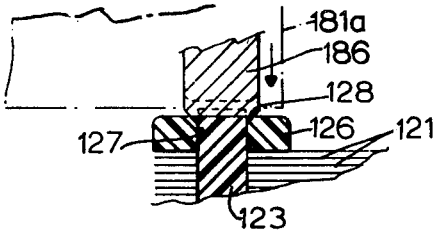

FIG. 30 shows an attachment 181a which carries reciprocating hot "Teflon" coated spot welding elements 186 which are heated to about the melting temperature of studs 123. Contact of such elements 186 with the upstanding ends of studs 123 causes deformation, particularly where the ends of studs 123 have been sheared off a spaced distance above the top of strip 126. Here again, it is preferable that counter sinks 128 be formed in the top surace of strip 126 to provide a smooth exposed surface. In this connection, it will be noted that the surface of strip 124 opposite its stud carrying surface is imperforate to provide a smooth nonscratching surface.

Figure 32:
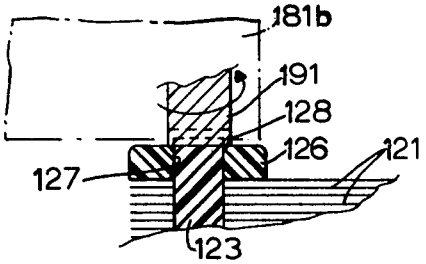

FIG. 32 shows an attachment 181b which carries a plurality of spinning elements 191. The spinning of elements 191 causes deformation of the ends of studs 123 particularly when the latter have been sheared off a spaced distance above the top of strip 126.

It will be understood, of course, that strips similar to strip 176 may be applied to the product after the ends of studs 123 have been deformed as in the manner indicated in FIGS. 30 to 32 by other means.

In the form of the invention shown in FIGS. 26–40, a bound book formed comprises a plurality of sheets 121 each formed with a plurality of spaced apertures 122 adjacent one marginal edge of each sheet and such sheets are clamped together by a spineless binding consisting of only two components. The first of these components is strip 124 havng integral solid thermoplastic studs 123 integral with the strip and projecting upright from one surface of the strip between opposite side edges thereof, thus providing the opposite surface substantially smooth and free of apertures. The surface which has the studs projecting therefrom fits against the outside of the pages 121 on one surface thereof with the studs extending through the holes 122. The second binding component is strip 126 which fits along the opposite surface of the book thus formed with the studs 123 fitting through the holes 127 and held therein by friction and by deformation of the ends of the studs to form heads directly in engagement with the side of the strip opposite the sheet side. FIG. 41 shows a front cover 196 for sheets 121 and a back cover 197. To facilitate opening the covers, reduced thickness portions 198 may be formed therein adjacent the margins near which holes 122 are located. The covers 196, 197 are dimensioned at least as large as the sheets 121 and thus resemble conventional book covers. Studs 23a either formed integrally with cover 196 or are secured thereto in some fashion forming no part of the present invention. Studs 123a penetrate the holes 122 in pages 121 and also penetrate holes 127a in cover 197. The ends of the studs 123a are sheared off and are secured to the cover 197a in the same manner as the corresponding elements are secured to the strip 126 in the forms of the invention shown in FIGS. 26–40.

The materials and structure of the strips described provide the following advantages:

(1) The strips contribute a dual means of binding and holding the sheets together, first, by studs which physically pass through holes in the sheets and, second, by frictional clamping force provided by the two pressure surfaces of the strips. These two factors cooperate to produce a total retentive force to keep the pages in place.

(2) The remaining ends of the studs, after shearing, may be formed by heating or by pressure, or a combination of the two, into rivet heads, each having the configuration of its respective counterbore in the female strip. In other words, the rivet head is not shaped primarily by a machine element but is shaped primarily by the counterbore of the female strips (3) The strips may be made to interface and cooperate with a binding machine in a manner permitting a pressure foot of the machine to press them together to a desired pressure, in a manner further to form resistance to a shear means of such machine allowing the excess length of the studs to be removed, and in a manner to permit a rivet head forming means to deform the remaining ends of the rivets into rivet heads fitting into the counterbores on the outside of the female strip, all together resulting in a machine-made bind utilizing the strips as the binding elements.

What is claimed is:

1. For use in binding a stack of sheets each formed with a plurality of apertures, a first strip and a second strip formed with apertures, said first strip having a first pressure-receiving surface and a second pressure-transmitting surface opposite said first surface, a plurality of longitudinally space-apart studs projecting upright from said second surface spaced along said first strip, and dimensioned and positioned to fit into said apertures in said second strip, said studs being smooth and of substantially uniform cross-section for their entire effective length said second strip having a third pressure-receiving surface and a fourth pressure-transmitting surface opposite said third surface.

2. The combination of claim 1 in which said apertures in said second strip are formed countersunk on at least one surface of said second strip.

3. Strips according to claim 1 in which said first strip is formed of an integral piece of thermoplastic material.

4. Strips according to claim 3 in which said studs are deformable.

5. Strips according to claim 3 in which said studs are deformable, said second strip being formed on its outer surface with depressions surrounding said apertures in said second strip.

6. Strips according to claim 5 in which said second strips are non-elastic whereby said depressions are stretch-resistant.

7. Strips according to claim 1 in which said second strips are formed with depressions in said fourth surface surrounding said apertures in said second strip.

8. Strips according to claim 1 in which said studs fit in said apertures in said second strip with a tight friction fit.

9. Strips according to claim 1 in which the distal ends of said studs are provided with an additional distal portion which is tapered.

10. Strips according to claim 1 in which said second strip is formed with first locating means offset relative to said apertures in said second strip, said first locating means adapted to cooperate with second locating means external to said strips to restrain said second strip against movement.

11. Strips according to claim 10 in which said first locating means is a hole in said fourth surface.

12. Strips according to claim 1 in which said second strip has a side edge surface adapted to butt against and be restrained from movement relative to external restraining means so that said strip resists movement when the excess lengths of said studs are severed.

* * * * *

REEXAMINATION CERTIFICATE (867th)

United States Patent [19] [11] B1 4,369,013

Abildgaard et al. [45] Certificate Issued Jun. 14, 1988

[54] BOOKBINDING STRIPS

[75] Inventors: William H. Abildgaard; Charles T. Groswith, III, both of Los Altos, Calif.

[73] Assignee: Velo-Bind, Inc., Sunnyvale, Calif.

Reexamination Request:
No. 90/001,243, May 12, 1987

Reexamination Certificate for:
Patent No.: 4,369,013
Issued: Jan. 18, 1983
Appl. No.: 142,269
Filed: Apr. 21, 1980

Reexamination Certificate B0 4,369,013 issued Jan. 18, 1983.

Related U.S. Application Data

[63] Continuation-in-part of Ser. No. 710,185, Jul. 30, 1976, abandoned, which is a continuation of Ser. No. 872,134, Oct. 29, 1969, abandoned, which is a continuation-in-part of Ser. No. 799,045, Feb. 13, 1969, Pat. No. 3,596,929.

[51] Int. Cl.[4] ..... B42B 5/08
[52] U.S. Cl. ..... 412/38; 402/80 P; 402/60; 402/43
[58] Field of Search ..... 412/38; 281/21 R, 22, 281/25 R, 28; 402/60, 64, 68, 80 P, 80 R

[56] References Cited

U.S. PATENT DOCUMENTS

| | | | |
|---|---|---|---|
| 88,369 | 3/1869 | Covert . | |
| 150,740 | 5/1874 | Baird . | |
| 277,456 | 5/1883 | Cagney . | |
| 937,191 | 10/1909 | Spence . | |
| 989,100 | 4/1911 | Wurzner . | |
| 1,040,506 | 10/1912 | Byron | 402/63 |
| 1,093,835 | 4/1914 | Crump | 281/25 R |
| 1,250,204 | 12/1917 | Morehouse | 281/25 R |
| 1,293,807 | 2/1919 | Krohmer | 281/25 R |
| 1,461,954 | 7/1923 | Wigginton . | |
| 1,561,638 | 11/1925 | Crowell . | |
| 1,697,327 | 1/1929 | Roe . | |
| 1,806,466 | 5/1931 | Kernan . | |
| 1,841,989 | 1/1932 | Smith . | |
| 1,876,419 | 9/1932 | Hutchings . | |
| 1,995,596 | 3/1935 | Adamson | 281/21 A |
| 2,180,965 | 11/1939 | Palmer et al. . | |
| 2,206,394 | 7/1940 | Farkas | 281/21 A |
| 2,239,036 | 4/1941 | Farkas | 11/1 A |
| 2,709,290 | 5/1955 | Rosenthal | 85/DIG. 2 |
| 2,841,848 | 7/1958 | Smith . | |
| 2,878,815 | 3/1959 | Pluckebaum . | |
| 2,940,199 | 6/1960 | Goldberg . | |
| 3,009,169 | 11/1961 | Bodner . | |
| 3,019,486 | 2/1962 | Stinson . | |
| 3,260,264 | 7/1966 | McKowen | 402/22 |
| 3,452,376 | 7/1969 | Ito | 11/1 R |
| 3,475,775 | 11/1969 | Staats | 11/1 DC |
| 3,596,929 | 8/1971 | Abildgaard | 281/21 R |

FOREIGN PATENT DOCUMENTS

| | | | |
|---|---|---|---|
| 116225 | 12/1942 | Australia . | |
| 121773 | 4/1946 | Australia . | |
| 157636 | 7/1954 | Australia . | |
| 235967 | 10/1961 | Australia . | |
| 250338 | 3/1964 | Australia . | |
| 61789 | 5/1964 | German Democratic Rep. | 402/68 |
| 741176 | 2/1933 | France | 402/47 |
| 837888 | 5/1938 | France | 402/80 R |
| Ad. 73145 | 9/1960 | France | 402/63 |
| 40-28866 | 4/1965 | Japan . | |
| 52488 | 5/1942 | Netherlands | 402/68 |
| 55660 | 3/1911 | Switzerland . | |
| 200616 | 7/1923 | United Kingdom . | |
| 203094 | 9/1923 | United Kingdom . | |
| 321594 | 11/1929 | United Kingdom . | |
| 470142 | 8/1937 | United Kingdom . | |
| 519400 | 3/1940 | United Kingdom . | |
| 587108 | 4/1947 | United Kingdom . | |
| 870006 | 6/1961 | United Kingdom . | |
| 950768 | 2/1964 | United Kingdom | 402/80 P |
| 956010 | 4/1964 | United Kingdom . | |
| 975183 | 11/1964 | United Kingdom | 402/80 P |
| 1093754 | 12/1967 | United Kingdom . | |
| 1095640 | 12/1967 | United Kingdom . | |

*Primary Examiner*—Paul A. Bell

[57] ABSTRACT

A bookbinding is provided by plastic studs which fit through holes vicinal one margin of each sheet and strips which are fixed to the ends of the studs. The studs may be formed integrally with one or, in alternating arrangement, with both strips and complementary holes formed in the matching strip or strips to receive the stud ends. Excess stud lengths are sheared and headed to lock the strips and interposed sheets in position. Both strips may be apertured and the studs inserted through the holes in the strips and interposed sheets, both ends of the studs being headed. To facilitate handling, strips may be assembled in cartridges or coils, and studs in rods or coils. For thicker books, strips are formed with flanges fitting behind the page margins. Spine concealing tapes and caps fit over or around the spine edges of the sheets.

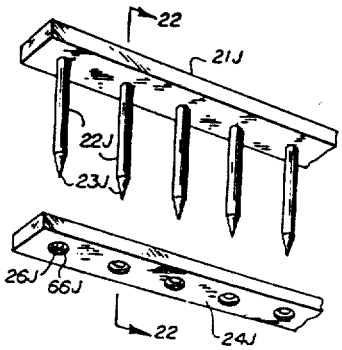

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 3 is cancelled.

Claims 1, 4 and 5 are determined to be patentable as amended.

Claims 2 and 6–12, dependent on an amended claim, are determined to be patentable.

1. For use in binding a stack of sheets each formed with a plurality of apertures, a first strip and a second strip formed with apertures, said first strip having a first pressure-receiving surface and a second pressure-transmitting surface opposite said first surface, a plurality of longitudinally space-apart studs projecting upright from said second surface spaced along said first strip, and dimensioned and positioned to fit into said apertures in said second strip, said studs being smooth and of substantially uniform cross-section for their entire effective length,

*said first strip being formed of an integral piece of thermoplastic material,* said second strip having a third pressure-receiving surface and a fourth pressure-transmitting surface opposite said third surface.

4. Strips according to claim [3] *1* in which said studs are deformable.

5. Strips according to claim [3] *1* in which said studs are deformable, said second strip being formed on its outer surface with depressions surrounding said apertures in said second strip.

* * * * *